US005160110A

United States Patent [19]

Praegitzer

[11] Patent Number: 5,160,110

[45] Date of Patent: Nov. 3, 1992

[54] CHRISTMAS TREE STAND

[76] Inventor: Robert L. Praegitzer, 1270 Monmouth Cut-Off, Dallas, Oreg. 97338-9532

[21] Appl. No.: 401,433

[22] PCT Filed: Sep. 25, 1987

[86] PCT No.: PCT/US87/02464

§ 371 Date: Jan. 14, 1991

§ 102(e) Date: Jan. 14, 1991

[87] PCT Pub. No.: WO89/03004

PCT Pub. Date: Apr. 6, 1989

[51] Int. Cl.[5] ..... F10M 13/00

[52] U.S. Cl. ..... 248/523; 47/40.5

[58] Field of Search ..... 248/519, 523, 524, 316.2, 248/525, 540, 541; 52/297; 47/40.5, 39; D11/130.1; 279/38, 35

[56] References Cited

U.S. PATENT DOCUMENTS

| | | | |
|---|---|---|---|
| 1,155,383 | 10/1915 | Tischer | 248/524 |
| 2,478,278 | 8/1949 | Kiesow | 248/524 X |
| 2,535,599 | 12/1950 | Preston | 279/35 X |
| 3,026,915 | 3/1962 | Jones | 279/35 X |
| 3,051,423 | 8/1962 | Wagner | 47/40.5 |
| 3,661,349 | 5/1972 | Vries | 47/40.5 |
| 4,913,395 | 4/1990 | Juhas | 47/40.5 X |
| 4,936,538 | 6/1990 | Royce | 248/524 |

FOREIGN PATENT DOCUMENTS

| | | | |
|---|---|---|---|
| 545486 | 5/1942 | United Kingdom | 47/40.5 |
| 2208591 | 4/1989 | United Kingdom | 248/523 |

*Primary Examiner*—J. Franklin Foss
*Attorney, Agent, or Firm*—Kolisch, Hartwell, Dickinson, McCormack & Heuser

[57] ABSTRACT

A stand (10) is provided for supporting an object (12), in a vertical orientation. The stand (10) includes a base (20) which has a holding mechanism (42) mounted thereon. The holding mechanism (42) includes gripping means (44) for gripping the object above the but end (18) thereof. An eccentric mount (98) provides means for shifting the horizontal position of the holding mechanism (42) relative to a center point (30) of the base (20), thereby to adjust the vertical alignment of the object (12).

26 Claims, 3 Drawing Sheets

CHRISTMAS TREE STAND

TECHNICAL FIELD

The instant invention relates to stands and specifically to a stand suitable for holding an object such as a Christmas tree.

BACKGROUND ART

Many forms of stands, and specifically many forms of stands suitable for supporting cut Christmas trees, are known. One such stand is described in U.S. Pat. No. 2,242,270 to Sims and discloses a stand supported by a tripod leg arrangement which has a rotating disc at the top thereof. When the disc is rotated, arms are caused to move from adjacent the edge of the disc toward the center thereof and grasp a tree trunk held in the stand. Such action is adequate to grasp the tree, however, does nothing to promote vertical alignment of the tree trunk.

A stand which does provide for vertical alignment is taught by Almer, et al., in U.S. Pat. No. 1,076,205, and provides a compressible clamping member through which the tree trunk extends. The clamping member is fixed in a desired location to support the tree. However, this device provides a fulcrum about which the tree may tip if adequate compression is not placed on the compressible member.

Rostomily, U.S. Pat. No. 4,190,983 discloses a tree support device which allows movement of the base of the tree relative to an upper portion thereof to provide vertical alignment of the trunk.

St. George Syms, U.S. Pat. No. 4,261,138 discloses a Christmas tree holder which utilizes a variety of wedge shaped instrumentalities which enable the user to adjust the vertical alignment of the tree in the stand.

The known stands do not provide an easily operated gripping mechanism for holding the tree trunk nor do the stands provide easy-to-operate mechanisms for vertically aligning the object in the stand. The devices disclosed in the aforementioned references, while useful, are not easily adjusted, nor, in some instances, do they provide for positive control over the object mounted in the stand to ensure that the object will remain in a desired vertical position, and will not become loose or tip over.

DISCLOSURE OF THE INVENTION

The stand of the instant invention includes a base which has means for positioning the butt end of an object, such as a cut Christmas tree, in the base. A holding mechanism is mounted on the base and holds the object in an upright condition. In the preferred embodiment, the holding mechanism includes plural gripping arms which grip the object above the butt end thereof. The arms have converging arcuate sides and an elongate, arcuate slot intermediate the ends thereof. The arms have free ends which contact the object and include pivot means at the other end thereof which are pivotably mounted in a ring-like mounting means.

The mounting means includes a top and a bottom ring for securing the arms. A cam ring is located between the top and the bottom ring and carries cam pins thereon. The cam pins cooperate with the elongate slots in the arms and are operable to selectively shift the arms between a gripping and a non-gripping position when the cam ring is moved relative to the top and bottom rings. Rotation/locking means are provided for rotating the cam ring relative to the mounting means and for locking the cam ring into a desired position.

Vertical alignment means is provided and is operatively connected to the mounting means for adjusting the vertical alignment of the object through horizontal shifting of the gripping arms.

An object of the instant invention is to provide a stand which will easily and positively grip an object mounted therein.

Another object of the instant invention is to provide a stand which will adjust for the vertical alignment of an object once the object is mounted therein.

A further object of the instant invention is to provide a stand which will hold an object therein and which will prevent relative rotation of the object and the stand.

Still another object of the instant invention is to provide a stand which includes a container capable of holding a quantity of material, such as water or sand, to provide ballast for the stand to prevent the object mounted therein from tipping over.

Another object of the instant invention is to provide a stand having a base which has a water-tight seal thereabout in order to contain a water supply for a Christmas tree mounted therein.

These and other objects and advantages of the instant invention will become more fully apparent as the description which follows is read in conjunction with the drawings.

BEST MODE OF CARRYING OUT THE INVENTION

Figure 1:
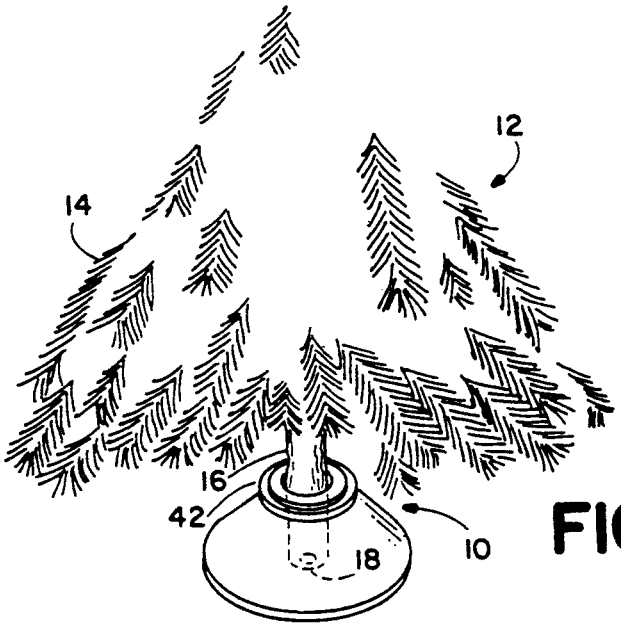
FIG. 1 is a perspective view of the stand of the invention having a Christmas tree mounted therein.

Turning initially to FIG. 1, the stand of the invention is shown generally at 10. The stand is suitable for holding an object, such as object 12, which is a cut Christmas tree. Tree 12 includes boughs 14 and a trunk 16. Boughs 14 extend along the length of trunk 16 however, the lower end of trunk 16 is free of boughs along its length and terminates in a butt end 18. Tree 12 is placed in stand 10 such that the stand holds the tree in a substantially vertical orientation.

Figure 2:
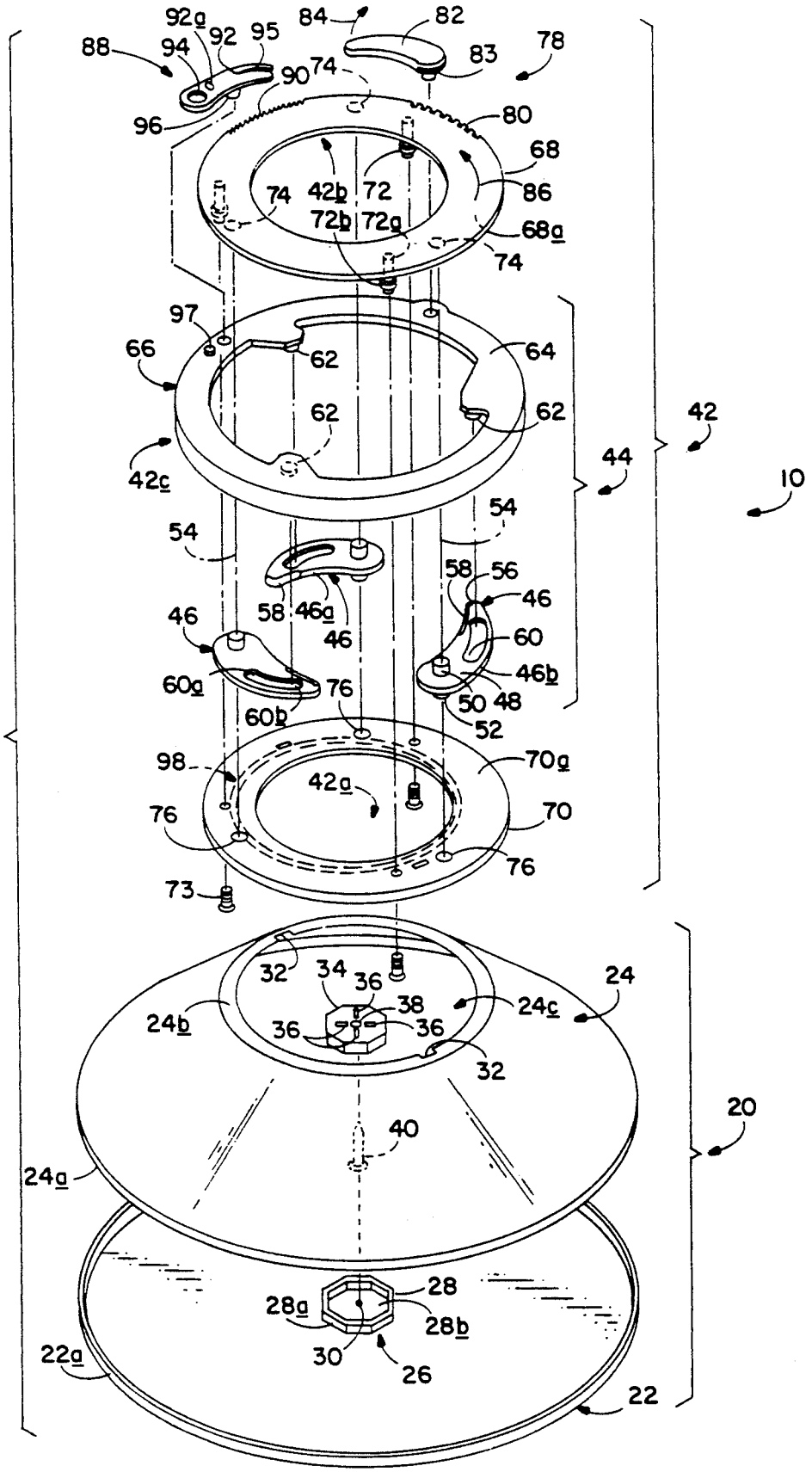
FIG. 2 is an exploded view of the stand of the invention.

Turning now to FIG. 2, stand 10 includes a base 20. Base 20 comprises a bottom portion 22 and a cover portion 24.

In the preferred embodiment, bottom portion 22 is a circular solid disk-like element which has a lip **22*a* extending about the periphery thereof. Bottom portion 22 has what is referred to herein as object-positioning means 26 located at the center thereof. In the preferred embodiment, object-positioning means 26 includes a receptacle 28 which has an octagonal configuration and includes an outer, octagonally shaped wall 28*a* and an inner, octagonally shaped well 28*b*. The center point 30 of bottom portion 22 is located in the center of well 28*b***.

Cover 24 is constructed such that it fits on bottom portion 22 and includes a flange 24a about the periphery thereof which is conformal with lip 22a and is received within the lip. Cover 24 has a substantially truncated conical form, with the larger end terminating in flange 24a and the smaller end having an annular flange 24b extending about an opening 24c which is formed in the small end of cover 24. Flange 24b has a pair of opposing notches 32 formed on the inner edge thereof.

Cover 24 and bottom portion 22 are secured together, as by adhesive or other suitable means, in order to form a water tight seal between lip 22a and flange 24a, so that water may be placed in the completed base in order to provide a water supply and ballast for an object placed in the stand. Should the object received in the stand not require water, other suitable ballast may be provided.

Figure 3:
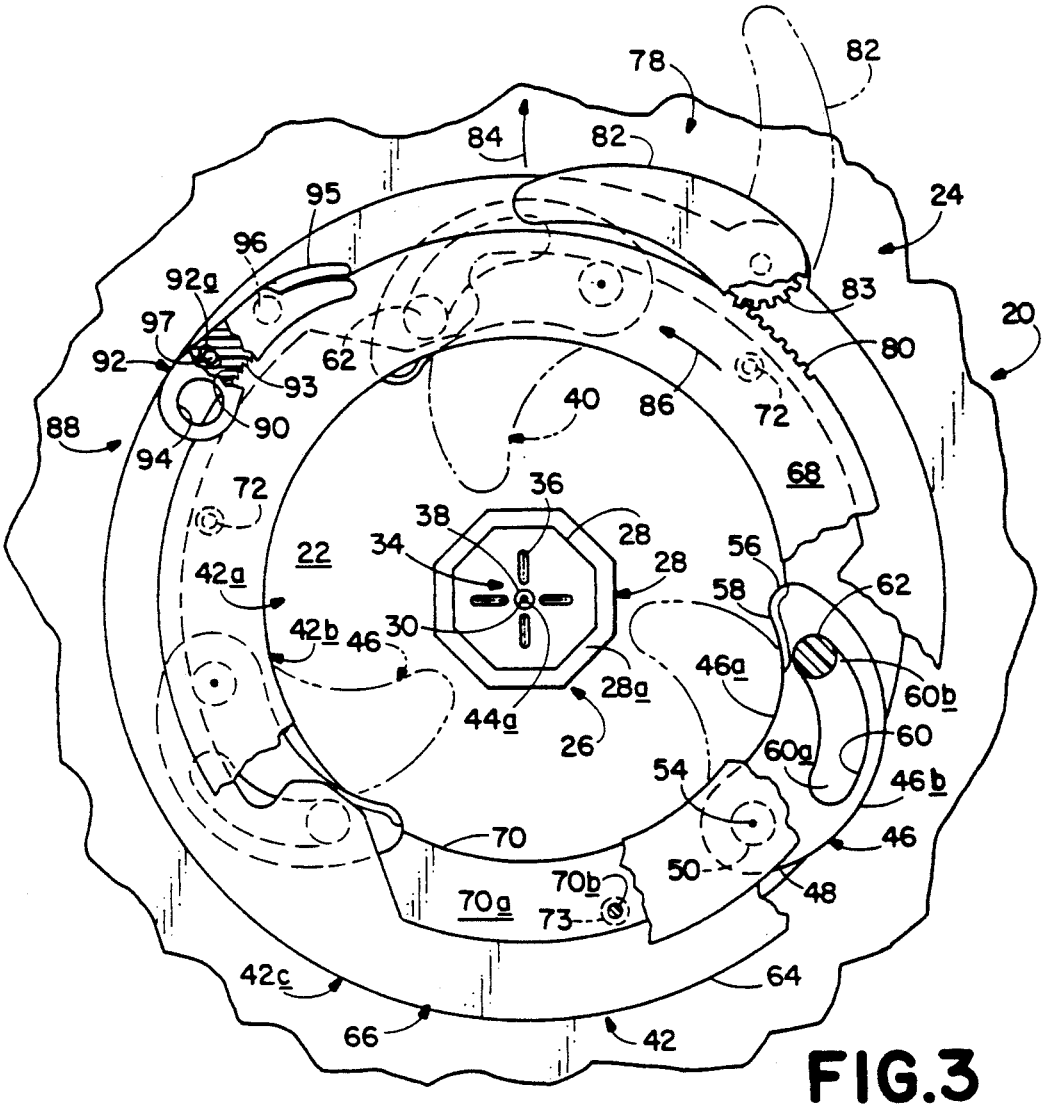
FIG. 3 is an enlarged top plan view of the holding mechanism of the invention, with portions broken away to show detail.

Referring now to FIGS. 2 and 3, butt piece 34 is provided and is intended to be secured to butt end 18 of tree 12. Piece 34 includes plural dogs 36, which take the form of raised elements on the upper surface of piece 34, and which are intended to bite into butt end 18 to prevent relative rotation between butt piece 34 and tree 12. Piece 34 includes a central bore 38 through which a nail 40 may be passed. The nail extends into the tree trunk to secure piece 34 to the trunk of the tree. Piece 34 is conformal with receptacle 28 and is operable to prevent relative rotation between tree 12 and base 20. Although, in the preferred embodiment, receptacle 28 is depicted as receiving butt piece 34 therein, it is apparent that any combination of elements on the base and the tree which serve to prevent relative rotation therebetween would fulfill the objects of object-positioning means 26.

Stand 10 also includes a holding mechanism 42 which is mounted on base 20 and is operable to hold tree 12 in an upright condition. In the preferred embodiment, holding mechanism 42 includes a number of elements which, when assembled, have a substantially ring-like appearance with a central opening 42a, an inner edge 42b and an outer edge 42c.

Holding mechanism 42 includes gripping means, shown generally at 44. Gripping means are operable for gripping tree 12 about trunk 16 above butt end 18 on trunk 16.

Gripping means in the preferred embodiment includes a set of plural, arcuate gripping arms 46. Arms 46 have a pair of opposed, converging arcuate sides 46a, 46b. A pivoting end 48 of arms 46 includes pivot means thereon for allowing pivoting of the arm relative to the remainder of holding mechanism 42. In the preferred embodiment, pivoting means takes the form of a top pivot pin 50 and a bottom pivot pin 52 which are constructed to define a pivot point 54. Free end 56 of arm 46 is located opposite pivoting end 48 and has a gripping jaw 58 formed on side 46a adjacent free end 56. Sides, or edges, 46a, 46b converge from pivoting end 48 towards free end 56.

An elongate, arcuate slot 60 is located in the upper surface of arm 46 intermediate the ends thereof. Slots 60 cooperate with cam pins 62 which are formed on the lower surface of a cam ring 64. Cam pin, 62 and cam ring 64 comprise what is referred to herein as arm-positioning means 66, which is operable to selectively shift arms 46 between a gripping position wherein they are thrust into the center of the holding mechanism and a non-gripping position wherein they are withdrawn towards the outer edge of the holding mechanism. When the arms are in their central, gripping position, they define gripping center 44a. As shown in FIG. 3, gripping center 44a is depicted as being located directly above center point 30.

Mounting means are provided for mounting arms 46 thereon. In the preferred embodiment, mounting means includes a top ring 68 and a bottom ring 70. Top ring 68 and bottom ring 70 have spaced apart, opposed facing surfaces 68a, 70a, respectively. Rings 68 and 70 are maintained in a spaced apart relationship by spacer pins 72. In the preferred embodiment, spacer pins 74 are integrally molded with ring 68 and included a shaft 72a having a flange 72b located adjacent the free end of the shaft. Bores 70b are provided in bottom ring 70 to receive the free ends of pins 72 therein. Each pin is secured to bottom ring 70 by means of a screw 73 which is received in a threaded receptacle in the pin. Plural, opposing, facing, spaced apart bores 74, 76 are formed in faces 68a, 70a, for receiving pins 50, 52, respectively, therein.

With the holding mechanism assembled, pivot pins 52 are received in bores 76 on bottom ring 70, cam ring 66 is installed over arms 46, with cam pins 62 received in the slots 60 and top ring 68 is fastened over cam ring 64 with pivot pins 50 received in bores 74. Movement of the arm-positioning means relative to the mounting means (top ring 68 and bottom ring 70) shifts arms 46 between their gripping and non-gripping positions.

Although the mechanism so far described is operable to hold a tree in position, in the preferred embodiment, rotation/locking means is provided to further facilitate placement and positioning of tree 12 in stand 10. Rotation/locking means includes, in the preferred embodiment, separate rotation and locking means.

Rotation means 78, also referred to herein as cam-ring-activation means, is operable to rotate cam ring 64 relative to the mounting means. A first set of teeth 80 are formed in an edge of top ring 68. A lever 82 having a set of teeth 83 thereon, wherein the teeth on the lever are conformal to the first set of teeth on the top ring, is provided to facilitate rotation of cam ring 64 relative to the mounting means. Lever 82 is mounted on cam ring 64 and, when the free end thereof is shifted in the direction indicated by arrow 84, causes mounting means to move in the direction indicated by arrow 86. This action moves arms 46 relative to cam pins 62, causing the cam pins to be shifted to ends 60a of slots 60. With cam pins 62 located in ends 60a, arms 46 are shifted into center opening 42a of the holding mechanism. Movement of the free end of lever 82 in a direction opposite that of arrow 84 causes movement of mounting means in the direction opposite arrow 86 and movement of cam pins 62 to ends 60b of slots 60, thereby withdrawing arms 46 towards outer edge 42c of holding mechanism 42.

Selective locking means 88 are provided for locking the cam ring in a set position relative to the mounting means, thereby selectively locking arms 46 in a set position. Locking means 88 includes a second set of teeth 90 formed on an edge of top ring 68 and also includes a locking ratchet 92 having a set of teeth 93 thereon. Teeth 93 are conformal to the teeth of the second set. A release grip 94 is included on ratchet 92. Ratchet 92 is rotatably mounted on cam ring 64 by means of mounting pin 96. Movement of ratchet 92 is limited by a pin 97 which is formed on cam ring 64 and extend through a slot 92a in ratchet 92. A spring 95 is operable to maintain ratchet 92 in an engaged condition with teeth 90. Ratchet 92 may be disengaged from top ring 68 by grasping grip 94 and pulling the grip outward from top ring 68. As lever 82 is drawn in the direction of arrow 84, teeth 90 will slip by teeth 93 but will prevent movement of the mounting means in a direction opposite arrow 86 until teeth 90 and 93 are disengaged, by an outward pull on release-grip 94.

Figure 4:
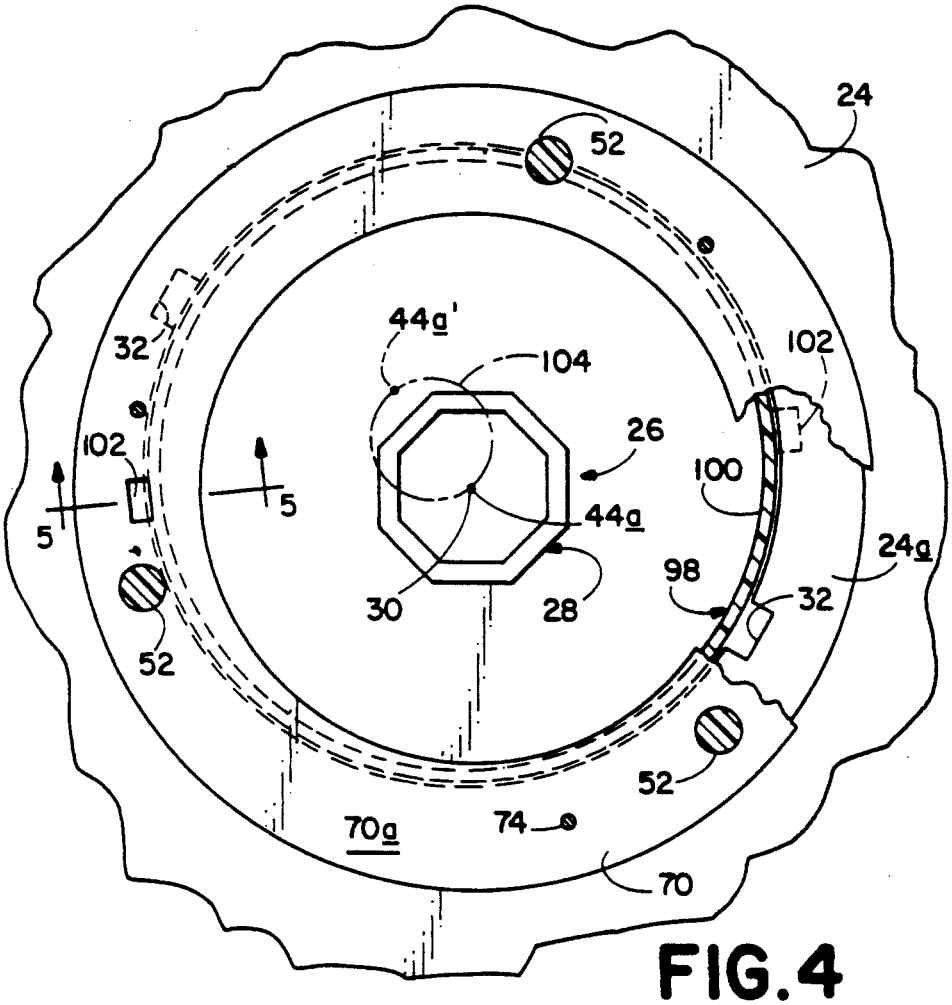
FIG. 4 is an enlarged top plan view of mounting means of the invention, with portions broken away to show detail.
Figure 5:
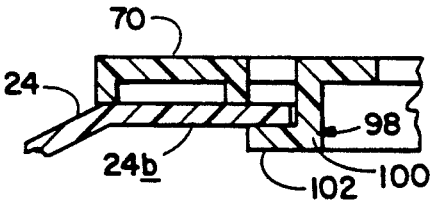
FIG. 5 is further enlarged sectional view of the mounting means of FIG. 4, taken generally along the line 5—5 of FIG. 4.

Referring now to FIGS. 2, 4 and 5, holding mechanism 42 is rotatably secured to base 20 by means of an eccentric mount 98. Mount 98 includes a circular ring 100 which is integrally formed with bottom ring 70. Ring 100 is, however, not concentric with ring 70, thereby providing the eccentricity which provides a means for shifting the horizontal position of the holding mechanism relative to center point 30 of base 20. Ring 100 has a pair of opposed tabs 102 extending outwardly from the bottom margin thereof. Tabs 102 are slightly larger than notches 32. Ring 70 is mounted on cover 24 of the base by forcing tabs 102 through notches 32, to place the tabs on the underside of cover flange 24*b*, with the bottom side of ring 70 then being slidably supported on the upper surface of flange 24*b*. This produces a relatively rotatable union between holding mechanism 42 and base 20.

The provision of the eccentric mount allows holding mechanism 42 to be shifted horizontally relative to center point 30, thereby adjusting the vertical alignment of tree 12 relative to base 20 by shifting the horizontal position of the gripping arms.

Referring now to FIG. 4, holding mechanism 42 is depicted in a position such that gripping center 44*a* is aligned with center point 30. When holding mechanism 42 is rotated, gripping center 44*a* follows the path indicated by dash-dot line 104. When holding mechanism 42 has been rotated by 180°, the gripping center will be located in the position indicated by 44*a*'. The amount of offset provided by eccentric mount 98 is sufficient to provide proper vertical alignment for Christmas trees as they are generally sold on the commercial market.

To briefly explain the use and operation of the stand, butt piece 34 is nailed to butt end 18 of tree 12, such that dogs 36 engage butt end 18 to prevent relative rotation of butt piece 34 and trunk 16. If arms 46 are not in their fully withdrawn, non-gripping position, release grip 94 is grasped and pulled outward, and the free end of lever 82 is moved to be adjacent ring 68, thereby shifting arms 46 to their fully withdrawn position. The tree is placed through the opening in the holding mechanism and butt piece 34 is inserted into receptacle 28. Lever 82 is shifted in the direction of arrow 84 until gripping jaws 58 have firmly grasped trunk 16. The entire holding mechanism is then rotated relative to base 20 until the proper vertical alignment of the tree is obtained. Base 20 is then filled with water in order to keep the tree fresh and also to provide ballast to prevent the tree and the stand from tipping over.

In order to remove the tree from the stand, release grip 94 is gasped and drawn outwards from the holding mechanism. Lever 82 is shifted opposite the direction of arrow 84 until it is fully contacting top ring 68, thereby freeing the hold of the gripping arms on the tree trunk. The tree may then be lifted out of the stand. Butt piece 34 is removed from the tree for use in future years.

INDUSTRIAL APPLICABILITY

Although the stand of the invention has been described as it may be used to hold a christmas tree, it should be appreciated that the stand is also operable to provide vertical support and alignment for any object which may be placed therein and grasped by the gripping arms.

Although a preferred embodiment of the invention has been described herein, it should be appreciated that, variations and modifications may be made thereto without departing from the scope of the invention as described in the appended claims.

I claim:

1. A stand, for an elongate, upright object, having a lower butt end, such as a tree, comprising:

a base, including object-positioning means for positioning the butt end of the object, a bottom portion carrying said object-positioning means thereon, and a cover secured to said bottom portion with a water-tight seal;

a holding mechanism mounted on said base for holding the object in an upright condition, including plural horizontally opposed gripping arms for gripping the object, with the object received in said base, above the butt end thereof, said arms having a free end for contacting the object and a pivoting end, having pivot means thereon;

ring-like mounting means for pivotably receiving said pivot means;

a cam ring constructed and arranged for rotational movement relative to said mounting means and operable, with said arms and said mounting means, to swing, with relative rotation in one direction, the free ends of the arms into the center of said mounting means, and, with relative rotation in the other direction, to swing the free ends of the arms towards the edge of said mounting means; and eccentric vertical alignment means operatively connected to said mounting means for adjusting the vertical alignment of the object through horizontal eccentric shifting of said mounting means, wherein said cover includes means for rotatably receiving said vertical alignment means thereon.

2. The stand of claim 1 wherein said gripping arms include an elongate, arcuate slot therein extending intermediate said free end and said pivoting end and said cam ring includes cam pins which are received in said slots for swinging said arms with relative rotation of said cam ring and said mounting means.

3. The stand of claim 2 wherein said arms include arcuate edges which converge from said pivoting end toward said free end.

4. The stand of claim 1 wherein said mounting means includes a top ring and bottom ring, and spacer means for maintaining a spaced apart relationship between said top and bottom rings, said top and bottom rings having opposed faces with plural bores formed therein, said pivot means on said arms including pivot pins which are received in said bores.

5. The stand of claim 4 wherein said cam ring is located between said top and bottom rings and which further includes rotation means for rotating said cam ring relative to said mounting means.

6. The stand of claim 4 which further includes locking means for locking said cam ring relative to said mounting means with said arms in a desired position.

7. The stand of claim 1 which further includes a butt piece, which is conformal with said object positioning means, for securing to the butt end of the object to the base in a non-rotational relationship, said object positioning means including a receptacle, said receptacle and said butt piece being constructed and arranged to prevent rotation of the object relative to said base.

8. A stand for an elongate, upright object, having a lower, butt end, such as a tree, comprising: a base for receiving the butt end of the object, said base having a center point; a holding mechanism mounted on said base for holding the object in an upright condition, including gripping means for gripping the object above the butt end; and eccentric, vertical alignment means operatively connected to said gripping means for adjusting the vertical alignment of the object.

9. The stand of claim 8 wherein said eccentric vertical alignment means includes means for shifting the horizontal position of said holding mechanism relative to said center point.

10. The stand of claim 8 wherein said gripping means includes plural gripping arms, having converging, arcuate sides, which are constructed and arranged to grip the object, and arm-positioning means for shifting said arms between a gripping position and a non-gripping position.

11. The stand of claim 10 wherein each of said arms includes an arcuate slot therein and said arm-positioning means includes a cam pin for each arm which cooperates with its respective slot to change the position of its respective arm when said positioning means is shifted.

12. The stand of claim 10 wherein said holding mechanism includes mounting means for pivotably mounting said arms thereon.

13. The stand of claim 12 wherein said mounting means includes a top ring and a bottom ring spaced apart from each other, said rings having facing, spaced apart bores in opposed faces thereof, said arms having pivot pins on the top and bottom sides at an end thereof which are fittable in said bores for providing a pivot point for said arms, and wherein said arm-positioning means includes cam ring, carrying said cam pins thereon, located between said top and bottom rings and rotatable relative thereto, rotation of said cam ring being operable to shift said arms between said aforementioned positions.

14. The stand of claim 13 which further includes cam-ring-activation means for rotating said cam ring relative to said mounting means.

15. The stand of claim 14 wherein said activation means includes a first set of teeth formed on said top ring, and a lever, rotatably mounted on said cam ring, having teeth conformal to said first set of teeth thereon, said lever, top ring and cam ring being constructed and arranged to provide rotation of said top ring relative to said cam ring when said lever is rotated.

16. The stand of claim 14 which includes selective locking means for selectively locking and unlocking said arms n a set position.

17. The stand of claim 16 wherein said selective locking means includes a second set of teeth formed on said top ring and a locking ratchet mounted on said cam ring for selective engagement with said second set of teeth, said ratchet, when in an engaged condition, being operable to retain said cam ring in a preset rotated position relative to said top ring.

18. The stand of claim 8, wherein said base includes a receptacle located about said center point and which further includes a butt piece for non-rotatable fixing to the butt end of the object, said butt and said receptacle being constructed and arranged to prevent relative rotation of the object and base.

19. A stand for an elongate, upright object, having a lower butt end, such as a tree, comprising:

a base for receiving the butt end of an object, said base having a center point;

a holding mechanism mounted on said base for holding the object in an upright condition, including plural, arcuate gripping arms having pivot means for pivotably mounting the arm at one end thereof, said arms having arcuate sides which converge from said one end to the other end thereof; and vertical alignment means for adjusting the vertical alignment of the object, attached to said holding mechanism for shifting, horizontally, said holding mechanism relative to said center point.

20. The stand of claim 19 wherein said holding mechanism includes a center and an edge thereabout and further includes mounting means for receiving said arms and arm positioning means for selectively moving said arms between a gripping position and a non-gripping position.

21. The stand of claim 20 wherein said mounting means includes a top ring and a bottom ring having spaced apart, opposed faces and opposed bores formed in said faces for pivotably receiving said pivot means therein, and wherein said arm positioning means includes a cam ring located between said top and bottom rings for relative movement thereto, said arms and said cam ring being constructed and arranged, with rotation of said cam ring relative to said mounting means in one direction, to swing said other end of said arms toward the center of the holding mechanism, and with rotation of said cam ring in the other direction, to swing said other end of said arm toward the edge of said holding mechanism.

22. The stand of claim 21 which further includes rotation/locking means for rotating said cam ring relative to said mounting means and for locking said cam ring in a desired position.

23. The stand of claim 19 wherein said vertical alignment means includes an eccentric mount for mounting said holding mechanism on said base.

24. The stand of claim 19 wherein said base includes a bottom portion having a receptacle located about said center point for holding the butt end of the object over the center point.

25. The stand of claim 24 which further includes a butt pieces which is conformal with said receptacle and is received therein, said receptacle and said butt piece being constructed and arranged to prevent rotation of the object relative to said base.

26. The stand of claim 2 wherein said base includes a cover secured to said bottom portion with a water-tight seal, said cover including means for receiving said holding mechanism thereon.

* * * * *